US005216454A

United States Patent [19]

Berke

[11] Patent Number: 5,216,454

[45] Date of Patent: Jun. 1, 1993

[54] WATER SPORTSMAN'S FACE MASK FOR VIEWING OBJECTS IN THE OPPOSITE DIRECTION OF THE NORMAL LINE OF VISION

[76] Inventor: Joseph J. Berke, 2063 Long Lake Shore, West Bloomfield, Mich. 48033

[21] Appl. No.: 553,885

[22] Filed: Jul. 13, 1990

[51] Int. Cl.[5] ..... G02C 1/00

[52] U.S. Cl. ..... 351/43; 351/158; 2/430

[58] Field of Search ..... 351/158, 43, 50, 442, 351/57; 2/430

[56] References Cited

U.S. PATENT DOCUMENTS 2,123,682 7/1938 Wingate .
2,358,348 9/1944 Pierson et al. .
2,594,698 4/1952 Thomas .
2,618,199 11/1952 Evans .
4,704,014 11/1987 Carner, Jr. ..... 351/43
4,795,235 1/1989 Spitzberg .
5,170,190 12/1992 Berke ..... 351/43

*Primary Examiner*—Rodney B. Bovernick
*Assistant Examiner*—Hung Xuan Dang
*Attorney, Agent, or Firm*—Alex Rhodes

[57] ABSTRACT

A water sportsman's face mask for enabling a person swimming on or below the surface of a body of water to view objects in the opposite direction to his normal line of vision. The mask comprises a frame, a lens mounted in the front portion of the frame, a flexible seal attached to the rear of the frame for forming a water-tight seal between the frame and the face of the swimmer, an adjustable strap for attaching the mask to the swimmer's head, and at least one prism in front of the lens having a pair of complementary faces which are inclined to the lens and internally reflect rays from objects behind the swimmer into his forward field of vision. In a second embodiment, a module is mounted on the front of a mask and has a pair of prisms, each having one member of a pair of complementary inclined faces for viewing objects behind a swimmer.

13 Claims, 2 Drawing Sheets

WATER SPORTSMAN'S FACE MASK FOR VIEWING OBJECTS IN THE OPPOSITE DIRECTION OF THE NORMAL LINE OF VISION

BACKGROUND OF THE INVENTION

This invention relates to face masks for water sportsmen and more particularly to a water sportsman's face mask for viewing objects in the opposite direction to a swimmer's normal forward line of vision.

Diving masks and swimmers' goggles are exemplary of face masks used by water sportsmen, including, recreational swimmers, scuba divers, snorklers, surfers and spear fishermen. They seal tightly against a sportsman's face and prevent water from contacting his eyes. Some masks also cover his nose and prevent water from entering his nose. They frequently include attached snorkels or are used with mouthpieces, breathing regulators and air tanks.

In many instances, while swimming on the surface or under the surface, hazards are present which can threaten the safety of a swimmer. These hazards include boats, debris, sharks, electric eels, men-of-war, rocks, reefs and the like and are potentially dangerous because of poor lighting and the reduced mobility of a swimmer over his mobility on dry land. Consequently, it is desirable for a swimmer to become aware of hazards as soon as possible.

Inasmuch as a person generally swims facing forward with his head erect to observe objects directly ahead, he is especially vulnerable to hazards which are out not in his forward field of vision. He is especially vulnerable to hazards behind him because, to view the area behind him, he must stop and rotate his entire body to face rearwardly.

Repetitive body movements for rearward viewing are tiresome, impede a swimmer's forward progress and detract from his enjoyment of the sport. They also interfere with his use of snorkels by limiting his positions and may cause him to intake water.

From the foregoing, it is apparent that a need exists for enabling a swimmer to view the area behind him while facing forward.

SUMMARY OF THE INVENTION

The present invention satisfies this need by providing a face mask with optical elements, each having a pair of complementary faces which cooperate to enable a swimmer to view objects in a direction opposite to his normal forward line of vision without requiring him to stop and rotate his body. The invention resides in the application of the optional elements to a face mask as well as the arrangement of the complementary faces for rearward viewing.

One benefit of the invention is that it is adaptable to a variety of face masks including divers' masks and swimmers' goggles. Another benefit is that it can be marketed as an accessory for current masks.

In a preferred embodiment, at least one prism is mounted on the front of a water sportsman's face mask. The prism has a pair of complementary faces which are inclined in opposite directions to the lens. The complementary faces internally reflect light rays from objects behind the swimmer into his forward field of vision. The internal reflection is due to the geometrical relationships of the prism faces and/or the mirrorizing of the inclined faces.

In a second embodiment, a modular unit having a pair of single reflecting prisms is mounted on the front of a face mask. The single reflecting prisms have complementary inclined faces which enable the swimmer to view objects behind him while facing forward.

The foregoing features and benefits of the invention, together with additional aspects features and benefits will be more apparent from the ensuing description and accompanying drawings which describe the invention in detail.

DETAILED DESCRIPTION OF A PREFERRED EMBODIMENT

Figure 4:
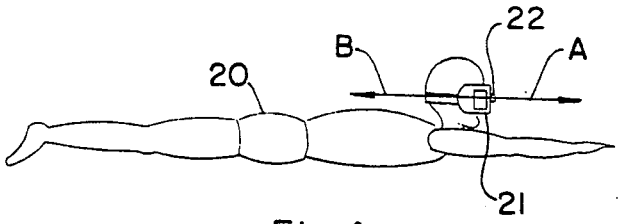
FIG. 4 is a side view of a swimmer.

Referring now to the drawings wherein like numerals designate like and corresponding parts throughout the several views, in FIG. 4 a swimmer 20 is shown wearing a diver's mask 21, and facing forward with his head erect to view objects directly ahead of the swimmer. The normal line of vision of the swimmer 20 is designated in FIG. 4 letter "A". As used herein, the normal line of vision "A" means the forward line of vision of a swimmer 20 with his head erect as shown in FIG. 4 and the words "behind the swimmer" mean in the opposite direction to his normal line of vision "A"; as designated by the letter "B".

The mask 21 has a pair of prisms 22 which enable the swimmer 20 to view objects behind the swimmer 20. Light rays from objects (not shown) behind the swimmer are reflected by the prism 22 to enable the swimmer 20 to view the objects behind the swimmer when facing in the manner shown in FIG. 4.

Figure 3:
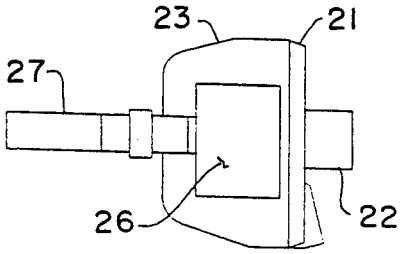
FIG. 3 is a right side view of the diver's mask of FIG. 1.
Figure 7:
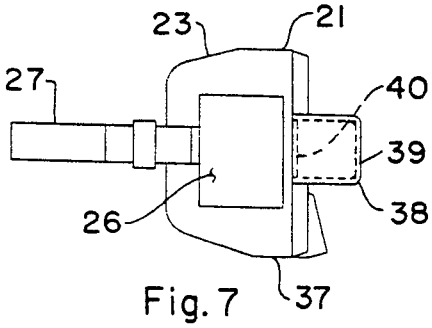
FIG. 7 is a right side view of the diver's mask of FIG. 5.
Figure 2:
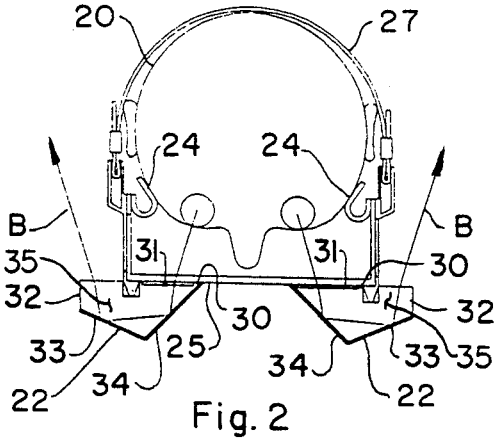
FIG. 2 is a cross-sectional view taken on the line 2—2 of FIG. 1.
Figure 1:
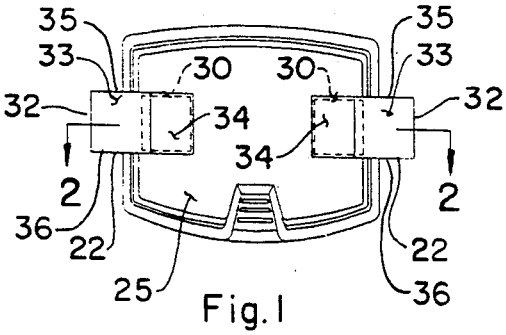
FIG. 1 is a front view of a driver's mask with a pair of double reflecting prisms mounted on the mask for viewing objects behind a swimmer.

The mask 21, as depicted in FIGS. 1 through 3, inclusive, has a frame 23, a flexible seal 24 attached to the rear of the frame 23 for sealing the frame 23 against the swimmer's face, a lens 25 mounted in the front of the frame 23 for viewing objects in the direction of the normal line of vision "A", a pair of lenses 26 mounted in the sides of the frame 23, an adjustable strap 27 for mounting the mask 21 on the head of the swimmer 20 and the two six sided double reflecting prisms 22 mounted on the front of the lens 25 for viewing objects in the direction generally designated by the line "B".

Figure 8:
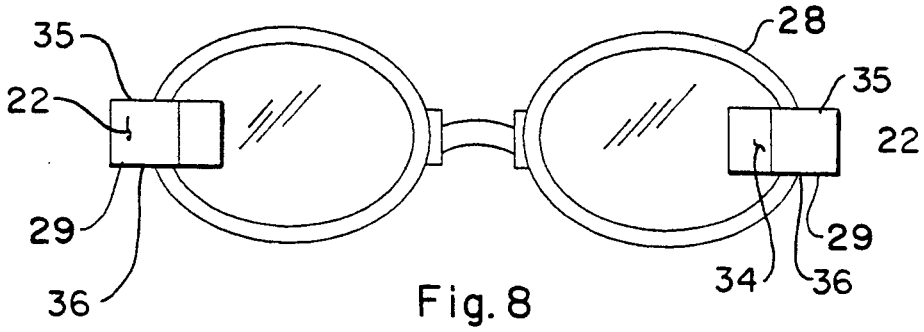
FIG. 8 is a front view of a pair of swimmers' goggles which embody my invention.

Although I have shown a diver's mask 21, it is not my intention to limit my invention to a diver's mask. As an example of the broad application of my invention to other water sportsmen's masks, I have also shown a pair of swimmers' goggles 28, in FIG. 8, having the same type of optical prisms 29 as the diver's mask 21 of FIGS. 1 through 3.

The prisms 22 are positioned on the mask 21 on or slightly below the swimmer's eye level, whereby objects behind the swimmer 20 can be viewed when the swimmer 20 is facing forward. One face 31 of each prism 21 is adjacent to the lens 25 and has a raised peripheral portion 30 which is adhesively bonded to the lens 25. One portion of the face 31 extends outwardly from the frame 23 whereby objects behind the swimmer are in the view of this face 31. A second face 34 is inclined and intersects the first face 31. The second face 34 extends outwardly and forwardly to intersect a third face 33 which extends outwardly and rearwardly to a fourth face 32 which connects the third 33 and first 31 faces. A fifth 35 and sixth 36 face interconnect the four other faces 31, 32, 33, and 34.

The prisms 22 are made of an optically clear glass or plastic and their faces S1, 33, 34 are polished to minimize distortion and transmissibility losses. Suitable polymers for the prisms 22 include polycarbonate and methyl methacrylate, by way of example, polymers sold under the trademarks, LEXAN and LUCITE, respectively. Faces 33 and 34 are preferably mirrorized so that light rays will be internally reflected inside of the prisms as shown in FIG. 2.

With reference to FIG. 2, the path of a light ray $u_I$ which enters and leaves an optical prism is governed by Snell's Law. Snell's Law states that when a light ray passes from one medium to another:

"The ratio of the sine of the angle of incidence (measured from the normal) to the sine of the angle of refraction (also measured from the normal) is a constant that is independent of the angle of incidence."

Accordingly, when a light ray passes through the interface between any two media I and II the following relationship applies.

$$U_I \sin\theta_I = U_{II} \sin \theta_{II} \text{ (Snell's Law)}$$

Where $u_I$ and $u_{II}$ are the absolute refractive indices of media I and II and $\theta_I$ and $\theta_{II}$ are the angles between the normal and rays in media I and II.

Note: The absolute refractive index (commonly referred to as the "refractive index") of dry air is 1.00029 and is usually treated as unity.

It should be noted from Snell's Law that when a light ray enters a denser medium (higher refractive index) it is refracted towards the normal and when a ray enters a less dense medium (lower refractive index) it is refracted away from the normal. Because of refraction, internal reflection can occur.

The minimum angle of incidence for internal reflection is commonly referred to as the "critical angle". It is important to note that internal reflection can only occur within a media of higher refractive index at a surface of contact with a medium of lower refractive index. Critical angles vary with materials and are easily determined by Snell's law where:

$$\theta_c = \arcsin U_I/U_{II} \text{ (critical angle)}$$

and $u_{II}$ must be greater than $u_I$

It should be noted that light rays which are normal to a prism face will not be refracted because the sine of the angle of incidence of a normal ray is zero.

Figure 9:
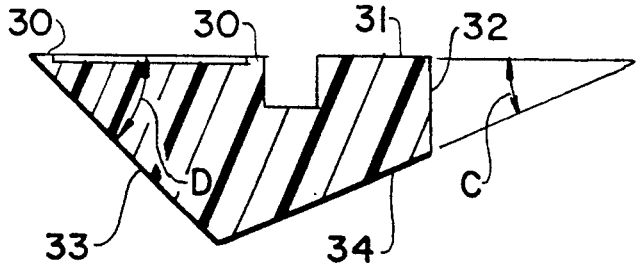
FIG. 9 is an enlarged view of a prism shown in FIG. 2.

For a methyl methacrylate prism (u=1.49) immersed in water (u=1.33), the critical angle for internal reflection to occur is 63.2 degrees. It therefore follows that if faces 33 and 34 of prism 22, shown in enlarged scale in FIG. 9, are not mirrorized, a ray will not be internally reflected if its angle of incidence with these faces 33 and 34 is less than 63.2 degrees. It also follows that mirrorizing is not required if the angles for the first 31 and second 34 faces are selected so that the angles of incidence of internal rays with respect to the second 34 and third 33 faces exceed the critical angle.

Thus, for a methyl methacrylate prism (u=1.49), shaped as shown in FIG. 9, immersed in water (u=1.33), mirrorizing can be eliminated for the second face 34 by increasing the included angle "C" between the first 31 and second 34 faces to more than 63.2 degrees. Likewise, mirrorizing of the third face 33 is not required if the included angle "D" between the first 31 and third faces 33 is greater than 63.2 degrees.

Figure 6:
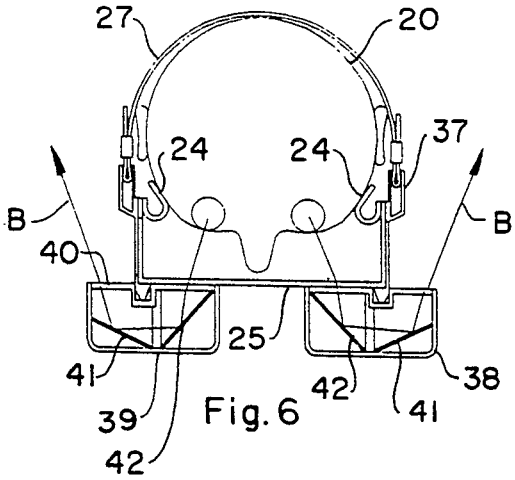
FIG. 6 is a cross-sectional view taken on the line 6—6 of FIG. 5.
Figure 5:
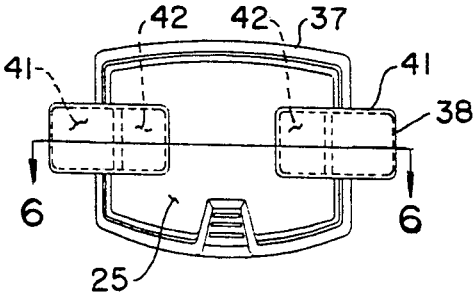
FIG. 5 is a front view of a diver's mask with a modular unit mounted on the mask for viewing objects behind a swimmer.

With reference to FIGS. 4 through 6, inclusive, an alternate embodiment 37 of the invention is shown therein having a pair of modular units 38 mounted on the front of a mask. Each modular unit 38 has a generally rectangular housing 39, a base plate 40 for sealing an open end portion of the housing 39 and a pair of spaced apart single reflecting prisms 41, 42.

The modular units 38 ar attached to the front of the mask 37 with an adhesive or some other conventional suitable means. As shown by the light rays which enter and leave the prisms, in FIG. 6, the single reflecting prisms 41, 42 inside of each housing 39 are optically equivalent to the single double reflecting prisms 22 of FIGS. 1-3.

From the foregoing it will be appreciated that my invention substantially improves a swimmer's safety and reduces his fatigue by enabling him to view the area behind him while swimming and facing forward.

Although but two embodiments of my invention have been described, it will be appreciated that other embodiments can be derived by substitution and changes in material, shape, and arrangement of parts without departing from the spirit thereof.

I claim:

1. A face mask for viewing object in a direction opposite to the normal line of visions comprising: a frame, said frame having an open font portion for receiving a lens; a lens mounted in said open front portion for enabling a swimmer to view object ahead of said swimmer; a flexible member attached to the rear portion of said frame for sealing said frame against the face of said swimmer; a means for attaching said mask to the head of said swimmer; and an optical means mounted on the front of said mask substantially at the eye level of said swimmer and having at lest one pair of complementary planar faces which are in inclined relationship to said lens, said faces cooperating to enable said swimmer to view objects behind him when he is facing forward without shifting the swimmer's eyes vertically up or down away from the normal line of visions of said swimmer.

2. The face mask recited in claim 1 further comprising a second optical means, said second optical means mounted don the front of said mask substantially at the eye level of said swimmer and having a pair of complimentary planar faces which are disposed in inclined relationship to said lens.

3. The face mask recited in claim 1 wherein said optical means is a double reflecting prism.

4. The face mask recited in claim 3 wherein said prism is methylmathacralate prism.

5. The faces mask recite din claim 3 wherein said prism is a six-sided prism having a first vertical planar face which is adjacent to said lens, a second vertical planar face which is inclined to said first vertical planar face and extends outwardly and forwardly away from said first vertical planar face; a third vertical planar face which is in inclined relationship to said first vertical planar face and extends outwardly and rearwardly away from said first vertical planar face; a fourth vertical planar face which interconnects said second and third vertical planar faces; and fifth and sixth horizontal planar faces which interconnect said other four vertical planar faces.

6. The face mask recited in claim 5 wherein one of said second and said third vertical planar faces in mirrorized.

7. The face mask recite din claim 5 wherein both of said second and third vertical planar faces are mirrorized.

8. The face mask recited in claim 5 wherein said angle between said first and said second vertical planar faces is at least 53.2 degrees.

9. The face mask recited in claim 1 wherein said optical means is a pair of single reflecting prisms, each of said prisms having one of said complimentary planar faces.

10. The face mask recited in claim 9 wherein the angle between said first and second vertical planar faces is at lest 63.2 degrees.

11. The face mask recited in claim 1 wherein said optical means is a module comprising: a transparent housing having an open portion; a transparent cover plate for sealing said open portion of said housing; and a pair of spaced apart single reflecting prisms inside of said housing, each of said prisms having one of said planar faces which is in inclined relationship to said lens.

12. A face mask for viewing object behind a forward facing swimmer comprising: a frame, a lens mounted din the front portion of said frame; a flexible member attached to the rear portion of said frame for sealing said frame against the face of a swimmer; a lens mounted int eh open front portion of said frame for enabling said swimmer, when facing forwardly, to view objects ahead of said swimmer int eh direction of the normal lien of visions of said swimmer; a means for attaching said mask to the head of said swimmer; and a pair of double reflecting prisms mounted on the front of said mask substantially at the eye level of said swimmer, each of said prisms having a first vertical planar face which is adjacent to said lens, a second vertical planar face which is in inclined relationship to said first vertical planar face and extend outwardly and forwardly from said first vertical planar face; a third vertical planar face which is in inclined relationship to said first vertical planar face and extends outwardly and rearwardly from said firs vertical planar face; a fourth vertical planar face which interconnects said second and third vertical planar faces; and fifth and sixth horizontal planar faces which interconnect said other four vertical planar faces.

13. In a face mask for a swimmer of the type having a frame, a lens mounted int he front portion of said frame, a flexible seal attached to the rear portion of the frame for sealing said frame against the face of a swimmer, a means for attaching said mask to the head of said swimmer, the improvement which comprises s angular means mounted substantially at the eye level of said swimmer for enabling said swimmer to view objects behind him when facing forward, said singular means comprising a prism mounted on the front portion of said frame for viewing objects behind said swimmer, said prism having complimentary vertical planar faces for internally reflecting light rays from objects behind said swimmer into said swimmer's forward field of vision.

* * * * *

UNITED STATES PATENT AND TRADEMARK OFFICE

CERTIFICATE OF CORRECTION

PATENT NO. : 5,216,454

DATED : June 1, 1993

INVENTOR(S) : Joseph J. Berke

It is certified that error appears in the above-identified patent and that said Letters Patent is hereby corrected as shown below:

Column 2, line 13, change "driver's" to --diver's--
Column 3, line 19, change "S1" to --31--
Column 4, line 23, change "ar" to --are--
Column 4, line 41, change "object" to --objects--
Column 4, line 42, change "visions" to --vision--
Column 4, line 43, change "font" to --front--
Column 4, line 45, change "object" to --objects--
Column 4, line 51, change "lest" to --least--
Column 4, line 60, change "don" to --on--

Column 5, line 1, change "faces" to --face--
Column 5, line 1, change "recite din" to --recited in--

Column 5, line 15, change "in" to --is--
Column 5, line 17, change "recite din" to --recited in--

Column 5, line 22, change "53.2" to --63.2--

Column 6, line 1, change "object" to --objects--
Column 6, line 3, change "din" to --in--
Column 6, line 6, change "int eh" to --in the--
Column 6, line 8, change "int eh" to --in the--
Column 6, line 9, change "lien" to --line--
Column 6, line 9, change "visions" to --vision--

UNITED STATES PATENT AND TRADEMARK OFFICE

CERTIFICATE OF CORRECTION

PATENT NO. : 5,216,454

DATED : June 1, 1993

INVENTOR(S) : Joseph J. Berke

It is certified that error appears in the above-indentified patent and that said Letters Patent is hereby corrected as shown below:

Column 6, line 26, change "int he" to --in the--

Column 6, line 30, change "s angular" to --a singular--

Signed and Sealed this

First Day of March, 1994

Bruce Lehman

*Attes::*

BRUCE LEHMAN

*Attesting Officer*

*Commissioner of Patents and Trademarks*